US011075488B2

(12) United States Patent
Evans et al.

(10) Patent No.: US 11,075,488 B2
(45) Date of Patent: Jul. 27, 2021

(54) IMPEDANCE CONTROL CONNECTOR WITH DIELECTRIC SEPERATOR RIB

(71) Applicant: TE Connectivity Services GmbH, Schaffhausen (CH)

(72) Inventors: Nicholas Lee Evans, Harrisburg, PA (US); Nathan William Swanger, Dillsburg, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/694,216

(22) Filed: Nov. 25, 2019

(65) Prior Publication Data

US 2021/0159644 A1 May 27, 2021

(51) Int. Cl.

| | |
|---|---|
| ***H01R 13/66*** | (2006.01) |
| ***H01R 13/11*** | (2006.01) |
| ***H01R 13/05*** | (2006.01) |
| *H01R 103/00* | (2006.01) |

(52) U.S. Cl.

CPC ..... *H01R 13/6616* (2013.01); *H01R 13/052* (2013.01); *H01R 13/111* (2013.01); *H01R 2103/00* (2013.01)

(58) Field of Classification Search

CPC ..... H01R 13/6616; H01R 13/052; H01R 13/111; H01B 2103/00

USPC ..... 439/620.21

See application file for complete search history.

(56) References Cited

U.S. PATENT DOCUMENTS

| | | | | |
|---|---|---|---|---|
| 4,226,495 | A * | 10/1980 | Palle | H01R 9/0506 439/535 |
| 7,195,518 | B2 * | 3/2007 | Bert | H01R 4/2441 439/290 |
| 7,316,584 | B2 * | 1/2008 | Mackillop | H01R 13/6463 439/607.05 |
| 7,604,505 | B2 * | 10/2009 | Zayas | H01J 5/54 439/617 |
| 8,591,268 | B2 * | 11/2013 | Reimchen | H01R 9/03 439/701 |
| 8,764,471 | B2 * | 7/2014 | Dang | H01R 13/639 439/310 |
| 9,048,564 | B2 * | 6/2015 | Dang | H01R 13/6463 |
| 9,257,796 | B1 * | 2/2016 | Dang | H01R 13/6463 |
| 9,281,598 | B2 | 3/2016 | Zebhauser et al. | |
| 9,306,312 | B2 * | 4/2016 | Dang | H01R 13/582 |
| 9,379,492 | B2 * | 6/2016 | Zebhauser | H01R 12/724 |
| 9,666,985 | B2 * | 5/2017 | Bernardi | H01R 13/631 |
| 9,722,348 | B2 * | 8/2017 | Zebhauser | H01R 13/514 |

(Continued)

*Primary Examiner* — Peter G Leigh

(57) ABSTRACT

A dielectric member for controlling impedance for use in an electrical connector. The dielectric member including a housing made of dielectric material and a dielectric rib. The dielectric rib extends from a conductor receiving end of the housing in a direction away from a mating end. The rib is spaced equidistant from each of the conductor receiving openings. The rib extends in a direction which is essentially parallel to a longitudinal axis of the housing. Conductor engaging surfaces are provided on the rib, with a first conductor engaging surface of the conductor engaging surfaces being opposed to a second conductor engaging surface of the conductor engaging surfaces. The first conductor engaging surface and the second conductor engaging surface are spaced apart a distance, wherein the impedance of the conductors proximate the rib is approximately the same as the impedance of the cable.

20 Claims, 4 Drawing Sheets

(56) References Cited

U.S. PATENT DOCUMENTS

| | | | | |
|---|---|---|---|---|
| 9,941,608 | B2 | 4/2018 | Zebhauser et al. | |
| 10,249,995 | B2 | 4/2019 | Zebhauser et al. | |
| 10,347,397 | B2 | 7/2019 | Armbrecht et al. | |
| 10,389,062 | B2 * | 8/2019 | Zebhauser | H01R 13/5845 |
| 10,396,472 | B2 | 8/2019 | Baldauf et al. | |
| 10,553,977 | B2 | 2/2020 | Pemwieser et al. | |
| 10,594,104 | B2 | 3/2020 | Hofling | |
| 2005/0227545 | A1 * | 10/2005 | Lahoreau | H01R 13/65912 439/695 |
| 2013/0023154 | A1 * | 1/2013 | Ii | H01R 13/65918 439/607.5 |
| 2015/0132994 | A1 | 5/2015 | Zebhauser et al. | |
| 2015/0349472 | A1 * | 12/2015 | Zebhauser | H01R 24/38 439/660 |
| 2017/0040087 | A1 | 2/2017 | Armbrecht et al. | |
| 2018/0366856 | A1 | 12/2018 | Pemwieser et al. | |
| 2019/0058296 | A1 | 2/2019 | Bredbeck | |
| 2019/0148865 | A1 | 5/2019 | Zebhauser et al. | |
| 2019/0173243 | A1 * | 6/2019 | Annequin | H01R 13/6474 |

* cited by examiner

IMPEDANCE CONTROL CONNECTOR WITH DIELECTRIC SEPERATOR RIB

FIELD OF THE INVENTION

The present invention is directed to an impedance control connector. In particular, the invention is directed to an impedance control connector which utilizes a ribbed dielectric to provide a stable transition zone impedance for twisted pair connector with long untwisted portion.

BACKGROUND OF THE INVENTION

Maintaining signal integrity in communications is always desired. Factors that affect signal integrity include cable design and the process that is used to terminate or attach a cable. Cables are typically made of at least one plated center conductor covered by a dielectric and a braid or foil shield protector with an overall non-conductive jacket. The termination of the braid onto a device, such as a printed circuit board (PCB) or a connector, can significantly affect cable performance.

Various methods are known to terminate shield connector, including soldering the end of the wire onto a PCB/connector termination, laser terminating parallel gap resistance welding. Another comment method of termination is to use a ferrule. One significant problem with a ferrule is that crimping the wire to apply the ferrule tends to crush the cable dielectric. Another problem with existing methods of terminating a braid is that they can tend to rearrange the placement of the differential pair within the cable jacket. Both problems can affect impedance and other electrical parameters, which affect signal integrity.

It would be, therefore, beneficial to provide an electrical connector which controls impedance and which does not damage or rearrange the conductors of the cable. In particular, it would be beneficial to provide an electrical connector which utilizes a ribbed between individual wire portions of the cable to control cable termination impedance.

SUMMARY OF THE INVENTION

An embodiment is directed to a dielectric member for controlling impedance for use in an electrical connector. The dielectric member including a housing made of dielectric material and a dielectric rib. The housing has a mating end and an oppositely facing conductor receiving end. Terminal receiving openings extend from the mating end to the conductor receiving end. The terminal receiving openings are dimensioned to receive terminals which are electrically connected to exposed ends of conductors of a cable. The dielectric rib extends from the conductor receiving end of the housing in a direction away from the mating end. The rib is spaced equidistant from each of the conductor receiving openings. The rib extends in a direction which is essentially parallel to a longitudinal axis of the housing. Conductor engaging surfaces are provided on the rib, with a first conductor engaging surface of the conductor engaging surfaces being opposed to a second conductor engaging surface of the conductor engaging surfaces. The first conductor engaging surface and the second conductor engaging surface are spaced apart a distance, wherein the impedance of the conductors proximate the rib is approximately the same as the impedance of the cable.

An embodiment is directed to an impedance control cable assembly for terminating a cable having exposed conductors. The cable assembly include a first metallic outer shell, a second metallic outer shell and a housing. The first metallic outer shell has a mating connector receiving portion, a housing retention portion and a second metallic outer shell receiving portion. The second metallic outer shell has a first metallic outer shell receiving portion, a conductor transition portion and a cable securing portion. The housing made of dielectric material, is positioned in the housing retention portion and the second metallic outer shell receiving portion of the first metallic outer shell and the first metallic outer shell receiving portion of the second metallic outer shell. The housing has a mating end and an oppositely facing conductor receiving end. Terminal receiving openings extend from the mating end to the conductor receiving end. The terminal receiving openings are dimensioned to receive terminals which are electrically connected to exposed ends of conductors of a cable. A dielectric rib extends from the conductor receiving end of the housing in a direction away from the mating end. The rib is spaced equidistant from each of the conductor receiving openings. The rib is positioned in the conductor transition portion of the second metallic outer shell.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
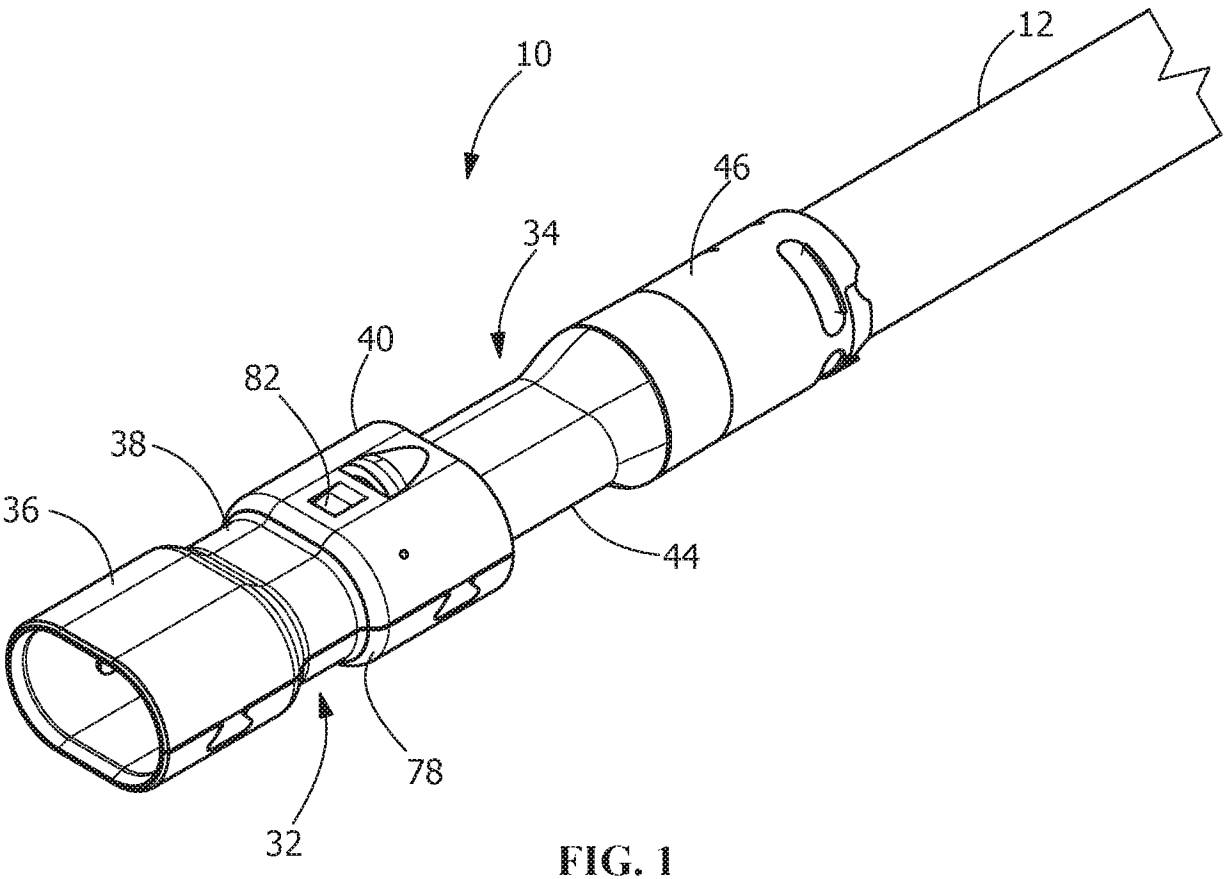
FIG. 1 is a perspective view of an electrical connector of the present invention fully assembled on a cable.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 6:
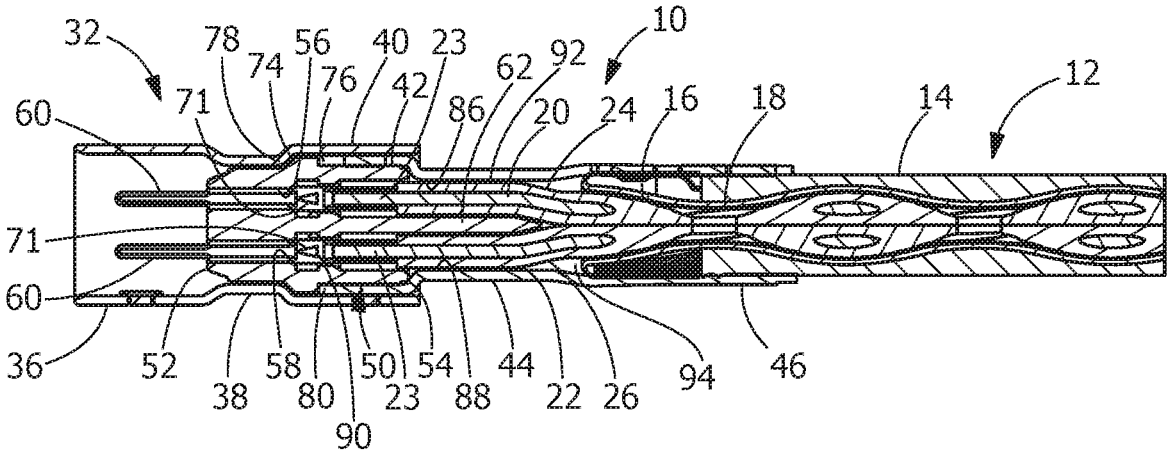
FIG. 6 is a cross sectional view of the electrical connector and cable taken along line 6-6 of FIG. 1.

As shown in FIGS. 1 and 6, an electrical connector assembly 10 is electrically and mechanically connected to a cable 12. The cable 12 can transfer data between and among storage devices, switches, routers, printed circuit boards (PCBs), analog to digital converters, connectors, and other devices. In various embodiments, the cable 12 can support data transfer rates of 100 Mbps and higher. In some embodiments, the cable 12 can support data transfer rates of approximately 4.25 Gbps to approximately 25 Gbps. The cable 12 also can be used with data transfer rates above or below these exemplary rates. As shown in FIG. 6, the cable 12 has a cable jacket 14, a braided shield 16, a metalized foil 18 and two center conductors 20, 22. The conductors 20, 22 are spaced from each other and extend essentially parallel to each other. The conductors 20, 22 are surrounded by the braided metal shield 16, such as, but not limited to braided copper shielding. The center conductors 20, 22 may also be surrounded by individual dielectrics 24, 26.

Figure 2:
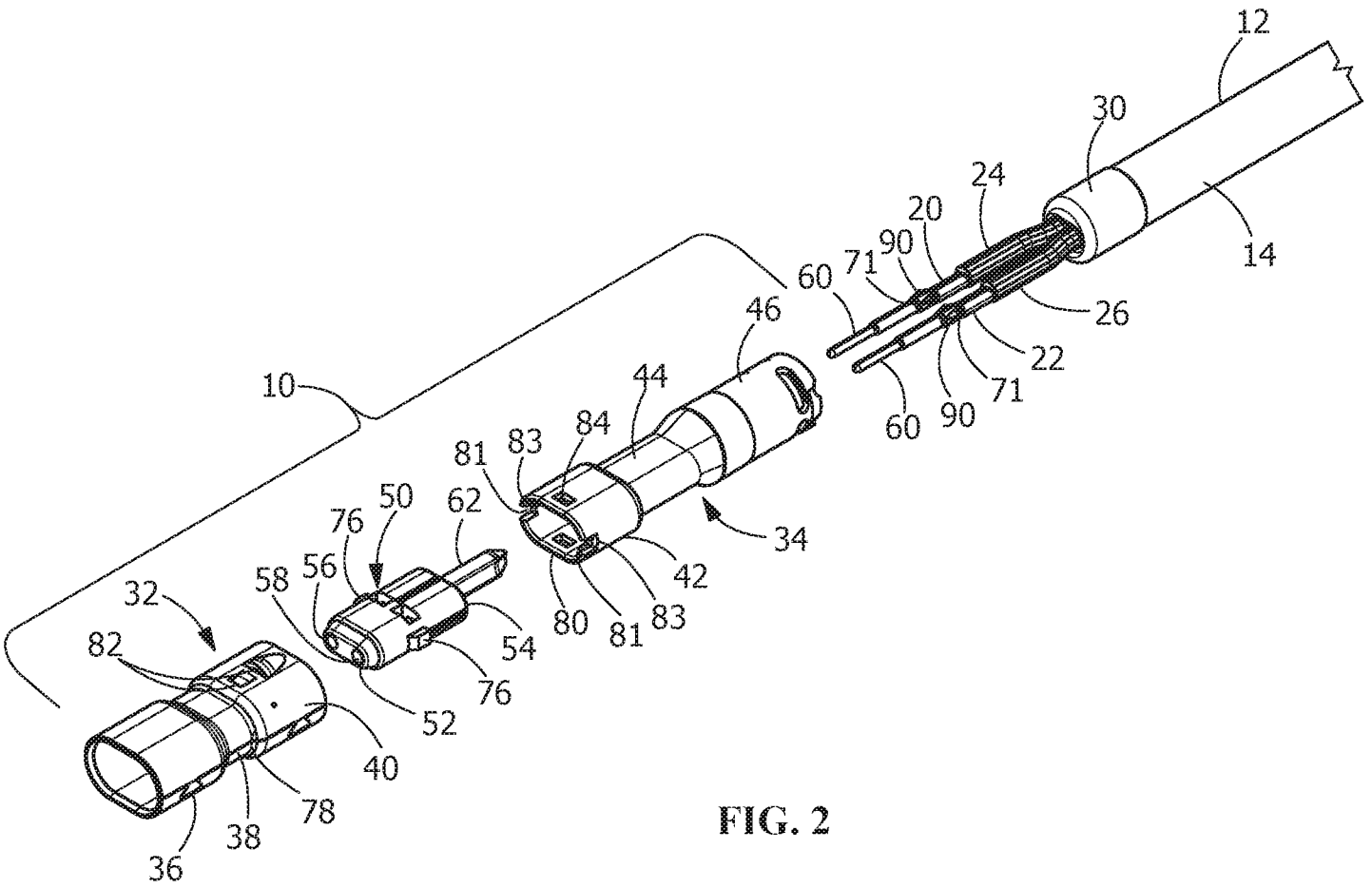
FIG. 2 is an exploded perspective view of the electrical connector of FIG. 1.

As shown in FIGS. 2 and 6, an end of the cable 12 has the cable jacket 14 removed. The dielectrics 24, 26 of the conductors 20, 22 are also removed, thereby exposing a portion of the conductors 20, 22.

Referring to FIGS. 1-2 and 6, the electrical connector assembly 10 has a first metallic outer shell 32 and a second metallic outer shell 34. The first metallic outer shell 32 has a mating connector receiving portion 36, a housing retention portion 38 and a second metallic outer shell receiving portion 40. The second metallic outer shell 34 has a first metallic outer shell receiving portion 42, a conductor transition portion 44 and a cable securing portion 46.

Figure 3:
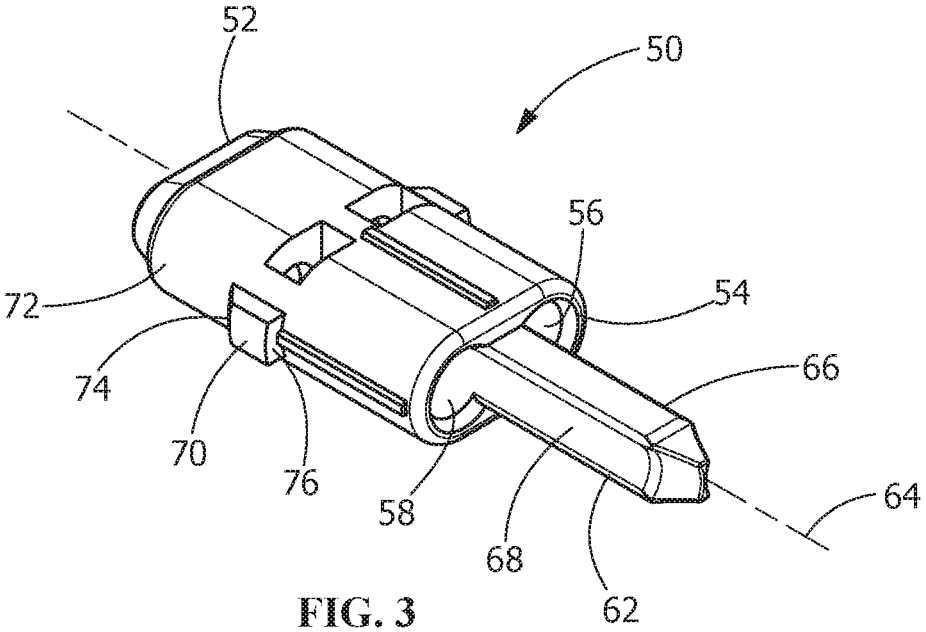
FIG. 3 is an enlarged perspective view of the dielectric housing shown in FIG. 2.
Figure 4:
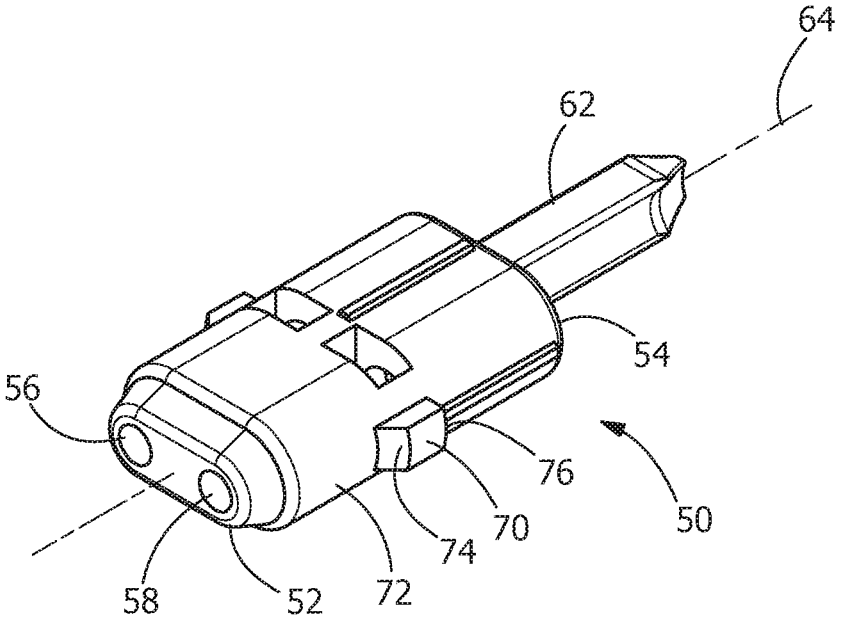
FIG. 4 is a plan view of a conductor receiving end of the dielectric housing.
Figure 5:
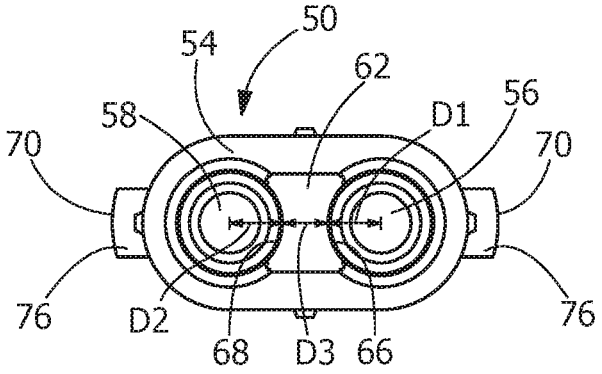
FIG. 5 is a cross-sectional view of the cable taken along line 5-5 of FIG. 1.
Figure 7:
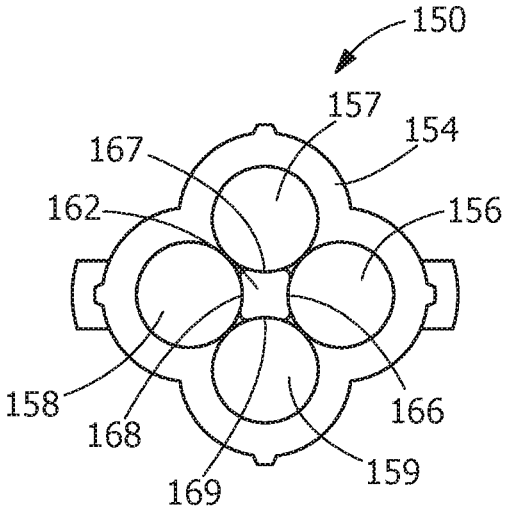
FIG. 7 is a plan view of a conductor receiving end of an alternate illustrative dielectric housing.

A dielectric housing 50 is positioned in the electrical connector assembly 10. The housing 50 made of dielectric material. As shown in FIGS. 2-4, the housing 50 has a mating end 52 and an oppositely facing conductor receiving end 54. Terminal receiving openings 56, 58 extend from the mating end 52 to the conductor receiving end 54. The terminal receiving openings 56, 58 are dimensioned to receive terminals 60 (FIGS. 2 and 6) through the conductor receiving end 54. The terminals 60 are electrically connected to the exposed ends of the conductors 20, 22 of the cable 12. In the embodiment shown, two terminal receiving openings 56, 58 are provided, however other numbers and configurations of the terminal receiving openings may be used, for example as shown in FIG. 7.

A dielectric rib 62 is integrally molded with the dielectric housing 50 and extends from the conductor receiving end 54 of the dielectric housing 50 in a direction away from the mating end 52. The rib 62 is spaced equidistant from the longitudinal axis of each of the terminal receiving openings 56, 58. In other words, the distance D1 between conductor receiving opening 56 and the rib 62 is equal to the distance D2 between conductor receiving opening 58 and the rib 62. The rib 62 extends in a direction which is essentially parallel to a longitudinal axis 64 of the housing 50. Conductor engaging surfaces 66, 68 are provided on the rib 62. In the embodiment shown, a first conductor engaging surface 66 is opposed to the second conductor engaging surface 68. The first conductor engaging surface 66 and the second conductor engaging surface 68 are spaced apart a distance D3, wherein the impedance between the conductors 20, 22 proximate the rib 62 matches or is approximately the same as the impedance of the cable 12. The first conductor engaging surface 66 and the second conductor engaging surface 68 have arcuate configurations, as shown in FIG. 4. However, in another embodiment, first and second engaging surfaces and 68 could have other configurations, such as non-arcuate configurations.

The dielectric housing 50 has mounting projections 70 which extend from side surface 72 thereof. The mounting projections each have a first shell engagement surface 74 and a second shell engagement surface 76.

When assembled, as shown in FIG. 6, the dielectric housing 50 is positioned in the housing retention portion 38 and the second metallic outer shell receiving portion 40 of the first metallic outer shell 32. The first shell engagement surfaces 74 of the mounting projections 70 engage an inner transition wall 78 of the housing retention portion 38 to properly position the housing 50 and prevent the further movement of the housing 50 into the mating connector receiving portion 36.

An end 80 of first metallic outer shell receiving portion 42 of the second metallic outer shell 34 is positioned within the second metallic outer shell receiving portion 40 of the first metallic outer shell 32. One or more latches 82 of the first metallic outer shell 32 cooperate with one or more openings 84 of the second metallic outer shell 34 to secure the second metallic outer shell 34 to the first metallic outer shell 32. Alternatively, the second metallic outer shell 34 is secured to the first metallic outer shell 32 by adhesive, or other know methods of attachment. In this position, the mounting projections 70 are positioned in recesses 81 which extend from the end 80 of the second metallic outer shell 34. End walls 83 of the recesses 81 engage the second shell engagement surfaces 76 of the mounting projections 70 to properly position the housing 50 and prevent the movement of the housing 50 into the second metallic outer shell 34.

The engagement of the first shell engagement surfaces 74 of the mounting projections 70 with the inner transition wall 78 of the housing retention portion 38 of the first metallic outer shell 32 and the engagement of the end walls 83 of the recesses 81 of the second metallic outer shell 34 properly position and retain the housing 50 in the assembled first metallic outer shell 32 and second metallic outer shell 34.

With the housing 50 properly positioned and secured in the housing retention portion 38 and the second metallic outer shell receiving portion 40 of the first metallic outer shell 32, the rib 62 extends from the conductor receiving end 54 into the first metallic outer shell receiving portion 42 and through the conductor transition portion 44 of the second metallic outer shell 34. The rib 62 and the second metallic outer shell 34 form conductor receiving passages 86, 88.

As shown in FIGS. 2 and 6, the terminals 60 of the electrical connector assembly 10 are terminated to ends of the conductors 20, 22 of the cable 12. Wire terminating portions 71 of the terminals 60 are crimped to the conductors 20, 22. However, other methods of terminating the terminals 60 to the conductors 20, 22 may be used. In the illustrative embodiment shown, the terminals 60 are male terminals with pin portions 72 extending from the wire terminating portions 71. However, other configurations of terminals, including, but not limited to, female socket terminals, may be used.

With the terminals 60 properly terminated to the conductors 20, 22, the terminals 60 are inserted through the cable securing portion 46. The terminals 60 are then inserted through the conductor receiving passages 86, 88 of the conductor transition portion 44 and into the terminal receiving openings 56, 58. Barbs or projections 90 of the terminals 60 engage and displace material in the terminal receiving openings 56, 58, thereby retaining the terminals 60 in the terminal receiving openings 56, 58.

With the terminals 60 properly secured, exposed portions 23 of the conductors 20, 22 are positioned in the conductor transition portion 44 of the second metallic outer shell 34, with the exposed portion 23 (FIG. 6) of one conductor 20 positioned proximate the first conductor engaging surface 66 in the first conductor receiving passage 86 and the exposed portion 23 of the other conductor 22 positioned proximate the second conductor engaging surface 68 in the second conductor receiving passages 88.

As shown in FIG. 6, the conductor receiving passages 86, 88 have conductor receiving portions 92 and conductor transition or spacing portions 94. The conductor spacing portions 94 extend at an angle relative to a longitudinal axis 64 of the housing 50 to receive and space apart the conductors 20, 22 as the conductors 20, 22 exit the cable 12. The conductor receiving portions 92 extend in a direction which is essentially parallel to the longitudinal axis 64 of the housing 50.

The positioning of the exposed portions 23 of the conductors 20, 22 in the conductor receiving passages 86, 88 maintains the proper positioning and desired spacing of exposed portions 23 of the conductors 20, 22. In the illustrative embodiment, the exposed portions 23 of the conductors 20, 22 in the conductor receiving passages 86, 88 extend substantially parallel to each other and in substantially the same plane. As the second metallic outer shell 34 surrounds the exposed portions 23 of the conductors 20, 22, the housing provides protection to the exposed portions 23 of the conductors 20, 22, preventing damage to the exposed portions 23 of the conductors 20, 22, thereby maintaining the integrity of the exposed portions 23 of the conductors 20, 22 and the signal path provided thereby.

As the spacing and dimension of the rib 62 of the dielectric housing 50 and the second metallic outer shell 34 are controlled during the manufacture of the component, the spacing of the exposed portions 23 of the conductors 20, 22 is also controlled when the exposed portions 23 of the conductors 20, 22 are positioned in the conductor receiving passages 86, 88. Consequently, by properly selecting the dielectric material used for the rib 62 and properly determining the thickness D3 of the rib 62, the impedance in the conductor transition portion 44 of the second metallic outer shell 34 can be tailored to match or approximately match the impedance of the cable 12. The positioning of the exposed portions 23 of the conductors 20, 22 in the conductor spacing portions 94 provides a transition between the conductor 20, 22 provided in the cable 12 and the exposed conductors 20, 22 positioned in the conductor receiving portions 92 of the conductor receiving passages 86, 88, thereby providing a controlled impedance in the conductor spacing portions 94.

The second metallic outer shell 34 is secured to the cable 12. As shown in FIG. 6, the cable securing portion 46 of the second metallic outer shell 34 is positioned over a portion of the cable 12 and the ferrule 30. The cable securing portion 46 is then secured, for example by crimping, to retain the second metallic outer shell 34 on the cable 12.

The electrical connector assembly 10, and in particular, the dielectric housing 50 and the rib 62, provides impedance control and does not damage or rearrange the conductors 20, 22. By properly selecting the dielectric material used for the rib 62 and properly determining the spacing between the conductor receiving passages 86, 88, the conductors 20, 22 are properly positioned and the impedance of the connector 10 can be tailored to match or approximately match the impedance of the cable 12, thereby optimizing the performance of the cable 12 and the electrical connector assembly 10.

Referring to FIG. 7, an alternate dielectric housing 150 is shown. The housing 150 made of dielectric material. Terminal receiving openings 156, 157, 158, 159 extend from the conductor receiving end 154. A dielectric rib 162 extends from the conductor receiving end 154 of the dielectric housing 150. The rib 162 is spaced equidistant from each of the terminal receiving openings 156, 157, 158, 159. The rib 162 extends in a direction which is essentially parallel to a longitudinal axis 164 of the housing 150. Conductor engaging surfaces 166, 167, 168, 169 are provided on the rib 162. In the embodiment shown, a first conductor engaging surface 166 is opposed to a second conductor engaging surface 168, and a third conductor engaging surface 167 is opposed to a fourth conductor engaging surface 169. The first conductor engaging surface 166 and the second conductor engaging surface 168 are spaced apart such that the impedance between the opposed conductors proximate the rib 162 matches or is approximately the same as the impedance of the cable. The third conductor engaging surface 167 and the fourth conductor engaging surface 169 are spaced apart such that the impedance between the opposed conductors proximate the rib 162 matches or is approximately the same as the impedance of the cable. The conductor engaging surfaces 166, 167, 168, 169 have arcuate configurations. However, other configurations for conductor engaging surfaces 166, 167, 168, 169 are possible such as non-arcuate.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A dielectric member for controlling impedance for use in an electrical connector in which conductors of a cable are terminated to terminals, the dielectric member comprising:

a housing made of dielectric material, the housing having a mating end and an oppositely facing conductor receiving end, terminal receiving openings extend from the mating end to the conductor receiving end, the terminal receiving openings being dimensioned to receive the terminals which are electrically connected to exposed ends of the conductors of the cable;

a dielectric rib extending from the conductor receiving end of the housing in a direction away from the mating end, the rib being spaced equidistant from a longitudinal axis of each of the terminal receiving openings, the rib extending in a direction which is essentially parallel to a longitudinal axis of the housing, conductor engaging surfaces are provided on the rib, the conductor engaging surfaces being configured to be positioned proximate the exposed ends of the conductors, a first conductor engaging surface of the conductor engaging surfaces being opposed to a second conductor engaging surface of the conductor engaging surfaces, the first conductor engaging surface and the second conductor engaging surface being spaced apart a distance and wherein the impedance of the exposed conductors proximate the rib is approximately the same as the impedance of the cable.

2. The dielectric member for controlling impedance as recited in claim 1, wherein two terminal receiving openings extend through the housing.

3. The dielectric member for controlling impedance as recited in claim 1, wherein four terminal receiving openings extend through the housing.

4. The dielectric member for controlling impedance as recited in claim 3, wherein the rib has a third conductor engaging surface and a fourth conductor engaging surface, the third conductor engaging surface being opposed to the fourth conductor engaging surface.

5. The dielectric member for controlling impedance as recited in claim 4, wherein the distance that the first conductor engaging surface is spaced from the second conductor engaging surface is equal to a distance that the third conductor engaging surface is spaced from the fourth conductor engaging surface.

6. The dielectric member for controlling impedance as recited in claim 4, wherein the first conductor engaging surface and the second conductor engaging surface face in directions which are perpendicular to direction that the third conductor engaging surface and the fourth conductor engaging surface face.

7. The dielectric member for controlling impedance as recited in claim 1, wherein the first conductor engaging surface and the second conductor engaging surface have arcuate configurations.

8. The dielectric member for controlling impedance as recited in claim 4, wherein the first conductor engaging surface, the second conductor engaging surface, the third conductor engaging surface and the fourth conductor engaging surface face having arcuate configurations.

9. An impedance control cable assembly for terminating a cable having exposed conductors, the cable assembly comprising:

a first metallic outer shell having a mating connector receiving portion, a housing retention portion and a second metallic outer shell receiving portion;

a second metallic outer shell having a first metallic outer shell receiving portion, a conductor transition portion and a cable securing portion;

a housing made of dielectric material, the housing positioned in the housing retention portion and the second metallic outer shell receiving portion of the first metallic outer shell and the first metallic outer shell receiving portion of the second metallic outer shell, the housing having a mating end and an oppositely facing conductor receiving end, terminal receiving openings extend from the mating end to the conductor receiving end, the terminal receiving openings being dimensioned to receive terminals which are electrically connected to exposed ends of conductors of a cable; and a dielectric rib extending from the conductor receiving end of the housing in a direction away from the mating end, the rib being spaced equidistant from a longitudinal axis of each of the terminal receiving openings, the rib positioned in the conductor transition portion of the second metallic outer shell, conductor engaging surfaces provided on the rib, the conductor engaging surfaces being configured to be positioned proximate the exposed ends of the conductors, wherein the impedance of the exposed conductors proximate the rib is approximately the same as the impedance of the cable.

10. The impedance control cable assembly as recited in claim 9, wherein the rib extends in a direction which is essentially parallel to a longitudinal axis of the housing.

11. The impedance control cable assembly as recited in claim 9, wherein conductor engaging surfaces are provided on the rib, a first conductor engaging surface of the conductor engaging surfaces being opposed to a second conductor engaging surface of the conductor engaging surfaces, the first conductor engaging surface and the second conductor engaging surface being spaced apart a distance, wherein the impedance of the exposed conductors proximate the rib matches the impedance of the cable.

12. The impedance control cable assembly as recited in claim 11, wherein the rib and the conductor transition portion of the second metallic outer shell form conductor receiving passages.

13. The impedance control cable assembly as recited in claim 9, wherein first shell engagement surfaces of mounting projections of the housing engage an inner transition wall of the housing retention portion of the first metallic outer shell to properly position the housing.

14. The impedance control cable assembly as recited in claim 13, wherein an end of first metallic outer shell receiving portion of the second metallic outer shell is positioned in the second metallic outer shell receiving portion of the first metallic outer shell.

15. The impedance control cable assembly as recited in claim 14, wherein one or more latches of the first metallic outer shell cooperate with one or more openings of the second metallic outer shell to secure the second metallic outer shell to the first metallic outer shell.

16. The impedance control cable assembly as recited in claim 14, wherein the end of first metallic outer shell receiving portion of the second metallic outer shell engages second shell engagement surface of the mounting projections of the housing to properly position the housing.

17. The impedance control cable assembly as recited in claim 9, wherein the rib has a first conductor engaging surface and an opposed second conductor engaging surface of the conductor engaging surfaces, the first conductor engaging surface and the second conductor engaging surface being spaced apart a distance, wherein the impedance of the conductors proximate the rib is approximately the same as the impedance of the cable.

18. The impedance control cable assembly as recited in claim 17, wherein the first conductor engaging surface and the second conductor engaging surface have arcuate configurations.

19. The impedance control cable assembly as recited in claim 18, wherein the rib has a third conductor engaging surface and a fourth conductor engaging surface, the third conductor engaging surface being opposed to the fourth conductor engaging surface.

20. The impedance control cable assembly as recited in claim 19, wherein the distance that the first conductor engaging surface is spaced from the second conductor engaging surface is equal to a distance that the third conductor engaging surface is spaced from the fourth conductor engaging surface.

* * * * *